US006758596B2

(12) United States Patent
McDonough

(10) Patent No.: US 6,758,596 B2
(45) Date of Patent: Jul. 6, 2004

(54) DISPOSAL BAG SYSTEM

(75) Inventor: John T. McDonough, Fargo, ND (US)

(73) Assignee: McDonough Concepts LLC, Fargo, ND (US)

( * ) Notice: Subject to any disclaimer, the term of this patent is extended or adjusted under 35 U.S.C. 154(b) by 30 days.

(21) Appl. No.: 10/302,396

(22) Filed: Nov. 22, 2002

(65) Prior Publication Data

US 2004/0101213 A1 May 27, 2004

(51) Int. Cl.[7] ..... B65D 30/00

(52) U.S. Cl. ..... 383/4; 383/25; D8/1; D34/1; 294/1.1; 294/156

(58) Field of Search ..... 383/4, 25; D8/1; D34/1; 294/1.1, 149, 156

(56) References Cited

U.S. PATENT DOCUMENTS

| | | | | | |
|---|---|---|---|---|---|
| 1,385,695 | A | * | 7/1921 | MacCormack et al. | 383/92 |
| 1,683,678 | A | * | 9/1928 | Kitterman | 383/22 |
| 2,254,578 | A | * | 9/1941 | O'Brien | 190/107 |
| 2,442,105 | A | * | 5/1948 | Vacheron | 2/69.5 |
| 2,479,203 | A | | 8/1949 | Brown | |
| 2,749,695 | A | * | 6/1956 | Hoopingarner | 15/257.6 |
| 2,766,797 | A | | 10/1956 | Cowen | |
| 4,175,602 | A | | 11/1979 | Cavalaris et al. | |
| 4,296,788 | A | * | 10/1981 | Slater | 383/4 |
| 4,467,989 | A | | 8/1984 | Stroh | |
| 4,471,600 | A | | 9/1984 | Dunleavy | |
| 4,519,183 | A | * | 5/1985 | Parody | 53/461 |
| 4,881,684 | A | * | 11/1989 | Chinman | 190/115 |
| 4,917,505 | A | * | 4/1990 | Bullard et al. | 383/4 |
| 4,938,607 | A | | 7/1990 | Kelley | |
| 5,092,681 | A | | 3/1992 | Ashley, III | |
| 5,364,188 | A | | 11/1994 | Godfried et al. | |
| 5,427,340 | A | | 6/1995 | Stromsmoe et al. | |
| 5,797,567 | A | | 8/1998 | Magnafici | |
| D410,574 | S | | 6/1999 | McCaig | |
| 6,003,717 | A | | 12/1999 | Long | |
| D422,855 | S | * | 4/2000 | Del Russo | D8/1 |
| 6,267,504 | B1 | | 7/2001 | Screen | |
| 6,302,583 | B1 | | 10/2001 | Steinmetz | |

* cited by examiner

*Primary Examiner*—Jes F. Pascua

(57) ABSTRACT

A disposal bag system for facilitating the efficient collection of debris and leaves. The disposal bag system includes a sheet member, a first connector attached to a first end of the sheet member, a second connector attached to a second end of the sheet member, loops attached to opposing sides of the sheet member, and hooks attached to the second end of the sheet member. The hooks engage the hooks thereby retaining the sides of the sheet member in an upward position. The first connector and the second connector are connected to one another thereby retaining the ends of the sheet member in an upward position thereby retaining the leaves and debris within the interior thereof.

20 Claims, 7 Drawing Sheets

DISPOSAL BAG SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to disposal bags and more specifically it relates to a disposal bag system for facilitating the efficient collection of debris and leaves.

2. Description of the Related Art

Conventional disposal bags (e.g. garbage bags) have been in use for years. Conventional disposal bags are typically comprised of a flexible material such as but not limited to plastic or paper. The conventional disposal bags have an opening, a side wall defining the opening and an enclosed floor. Some conventional disposal bags have a drawstring surrounding the opening for allowing selective closing of the opening by pulling the drawstring. Other disposal bags require the user to tie the open end either with the ends of the sidewall or by utilizing a tie-wrap member.

The main problem with conventional disposal bags is that it can be difficult to insert debris and leaves into the opening. Inserting leaves and debris into the opening requires the user to open the opening of the bag with one hand while further manipulating the opening with their leg to ensure that the opening is wide enough. The user then utilizes their remaining hand to grasp the leaves and debris for insertion into the conventional disposal bag. This is physically difficult for the user and often times results in leaves and debris not completely inserted into the opening. A further problem with conventional disposal bags is that the user must "tie" the opening into a closed position which can result in the breakage of the drawstring or other frustrating events. A further problem with conventional disposal bags is that they are typically not able to be reused.

Examples of patented devices which may be related to the present invention include U.S. Pat. No. 2,766,797 to Cowen; U.S. Pat. No. 5,364,188 to Godfried et al.; U.S. Pat. No. 5,092,681 to Ashley, III; U.S. Pat. No. 4,938,607 to Kelley; U.S. Pat. No. 4,471,600 to Dunleavy; U.S. Pat. No. 2,479,203 to Brown; U.S. Pat. No. 5,797,567 to Magnafici; U.S. Pat. No. 5,427,340 to Stromsmoe et al.; U.S. Pat. No. 4,175,602 to Cavalaris et al.; U.S. Pat. No. 4,467,989 to Stroh; U.S. Pat. No. 6,003,717 to Long; U.S. Patent D410,574 to McCaig; U.S. Pat. No. 6,302,583 to Steinmetz; and U.S. Pat. No. 6,267,504 to Screen.

While these devices may be suitable for the particular purpose to which they address, they are not as suitable for facilitating the efficient collection of debris and leaves. Conventional disposal bags do not provide for efficient collection of debris and leaves.

In these respects, the disposal bag system according to the present invention substantially departs from the conventional concepts and designs of the prior art, and in so doing provides an apparatus primarily developed for the purpose of facilitating the efficient collection of debris and leaves.

BRIEF SUMMARY OF THE INVENTION

In view of the foregoing disadvantages inherent in the known types of disposal bags now present in the prior art, the present invention provides a new disposal bag system construction wherein the same can be utilized for facilitating the efficient collection of debris and leaves.

The general purpose of the present invention, which will be described subsequently in greater detail, is to provide a new disposal bag system that has many of the advantages of the disposal bags mentioned heretofore and many novel features that result in a new disposal bag system which is not anticipated, rendered obvious, suggested, or even implied by any of the prior art disposal bags, either alone or in any combination thereof.

To attain this, the present invention generally comprises a sheet member, a first connector attached to a first end of the sheet member, a second connector attached to a second end of the sheet member, loops attached to opposing sides of the sheet member, and hooks attached to the second end of the sheet member. The hooks engage the hooks thereby retaining the sides of the sheet member in an upward position. The first connector and the second connector are connected to one another thereby retaining the ends of the sheet member in an upward position thereby retaining the leaves and debris within the interior thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a disposal bag system that will overcome the shortcomings of the prior art devices.

A second object is to provide a disposal bag system for facilitating the efficient collection of debris and leaves.

Another object is to provide a disposal bag system that does not require significant physical exertion by the user.

An additional object is to provide a disposal bag system that allows for the user to rake leaves and debris directly upon a flat structure for collection.

A further object is to provide a disposal bag system that retains the collected leaves and debris in a waterproof structure.

Another object is to provide a disposal bag system that allows for convenient stacking of filled structures.

A further object is to provide a disposal bag system that can be easily opened for emptying the contents within thereof.

Another object is to provide a disposal bag system that is capable of reuse.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
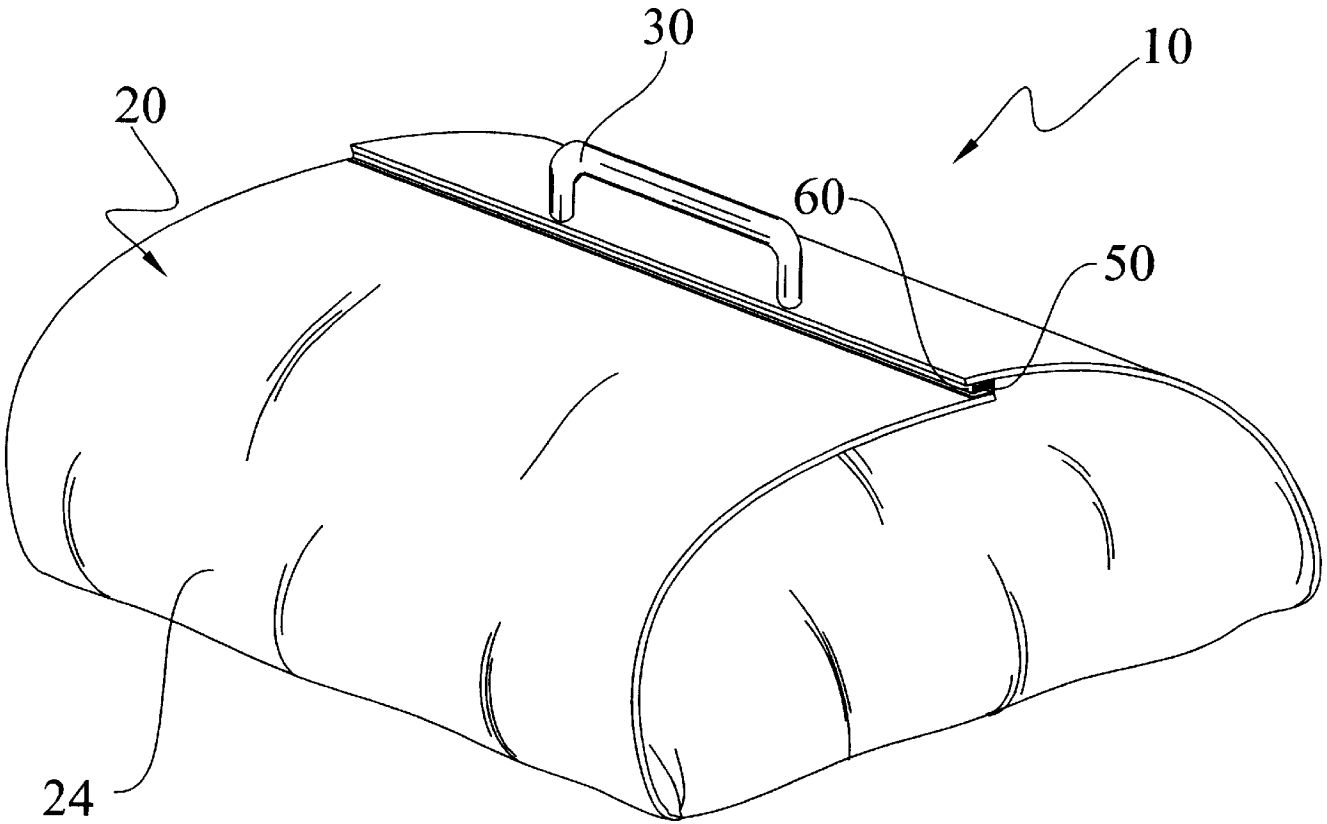
FIG. 1 is an upper perspective view of the present invention in the closed position.

Turning now descriptively to the drawings, in which similar reference characters denote similar elements throughout the several views, FIGS. 1 through 7 illustrate a disposal bag system 10, which comprises a sheet member 20, a first connector 50 attached to a first end of the sheet member 20, a second connector 60 attached to a second end of the sheet member 20, loops 42 attached to opposing sides of the sheet member 20, and hooks 40 attached to the second end of the sheet member 20. The hooks 40 engage the hooks 40 thereby retaining the sides of the sheet member 20 in an upward position. The first connector 50 and the second connector 60 are connected to one another thereby retaining the ends of the sheet member 20 in an upward position thereby retaining the leaves 12 and debris within the interior thereof.

Figure 2:
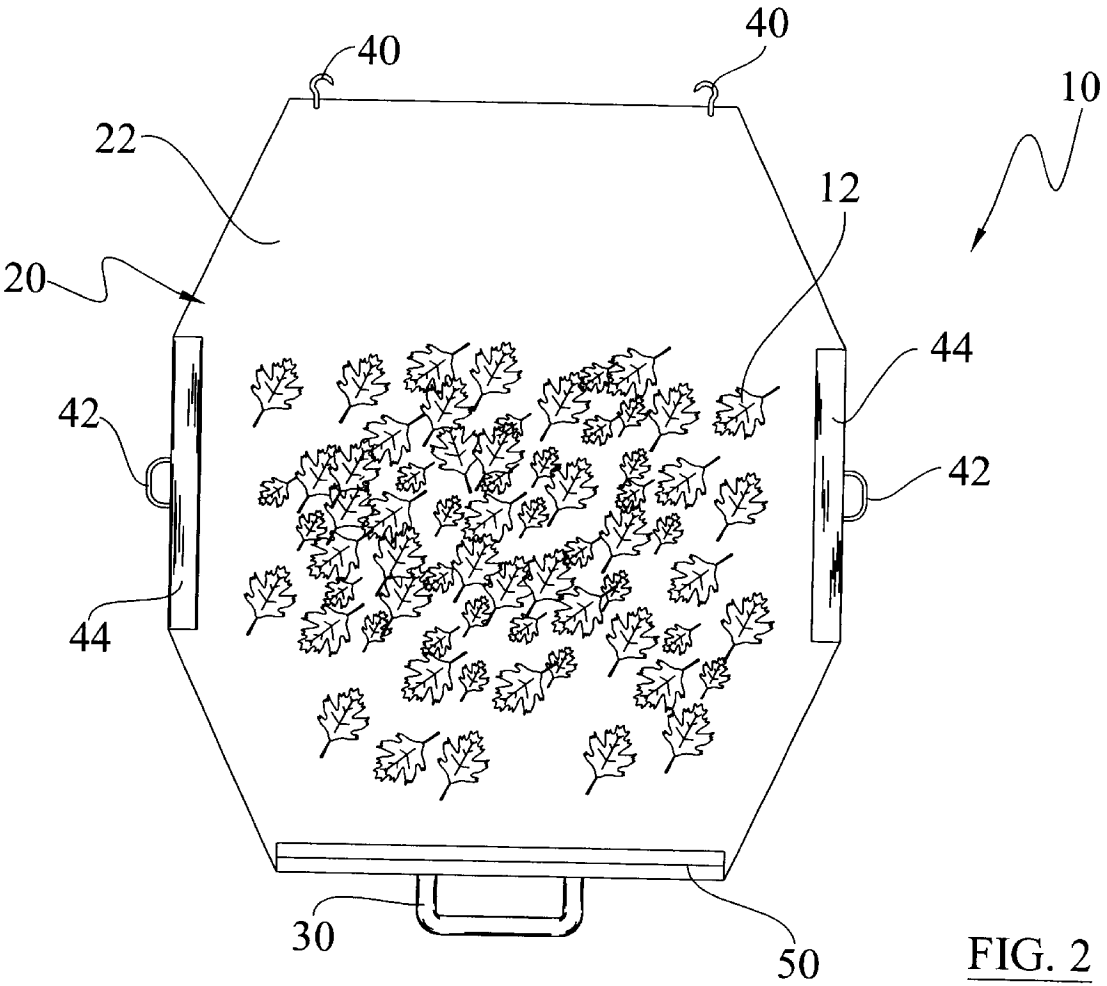
FIG. 2 is a top view of the present invention in the open position with leaves positioned upon the inner surface thereof.
Figure 6:
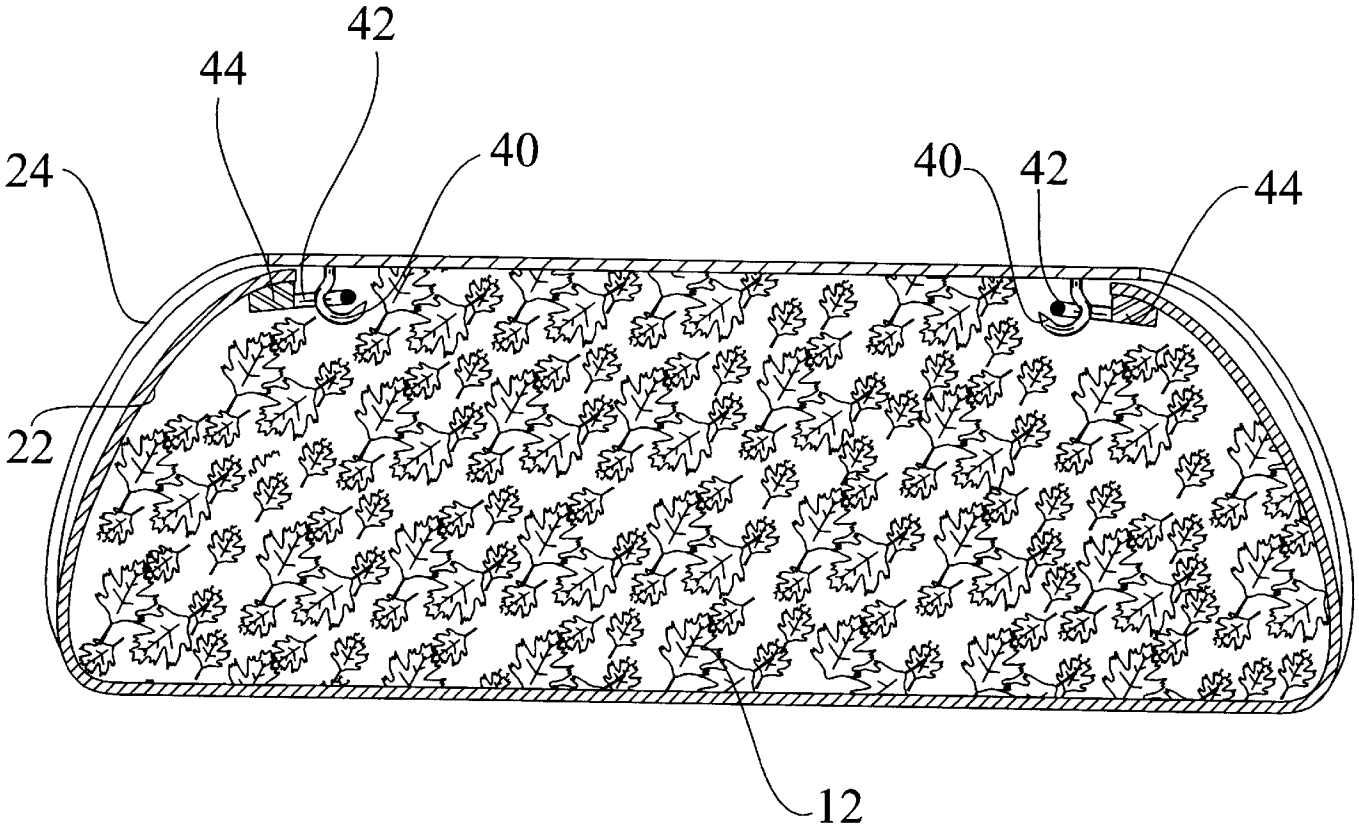
FIG. 6 is a side cutaway view taken along line 6—6 of FIG. 4.
Figure 7:
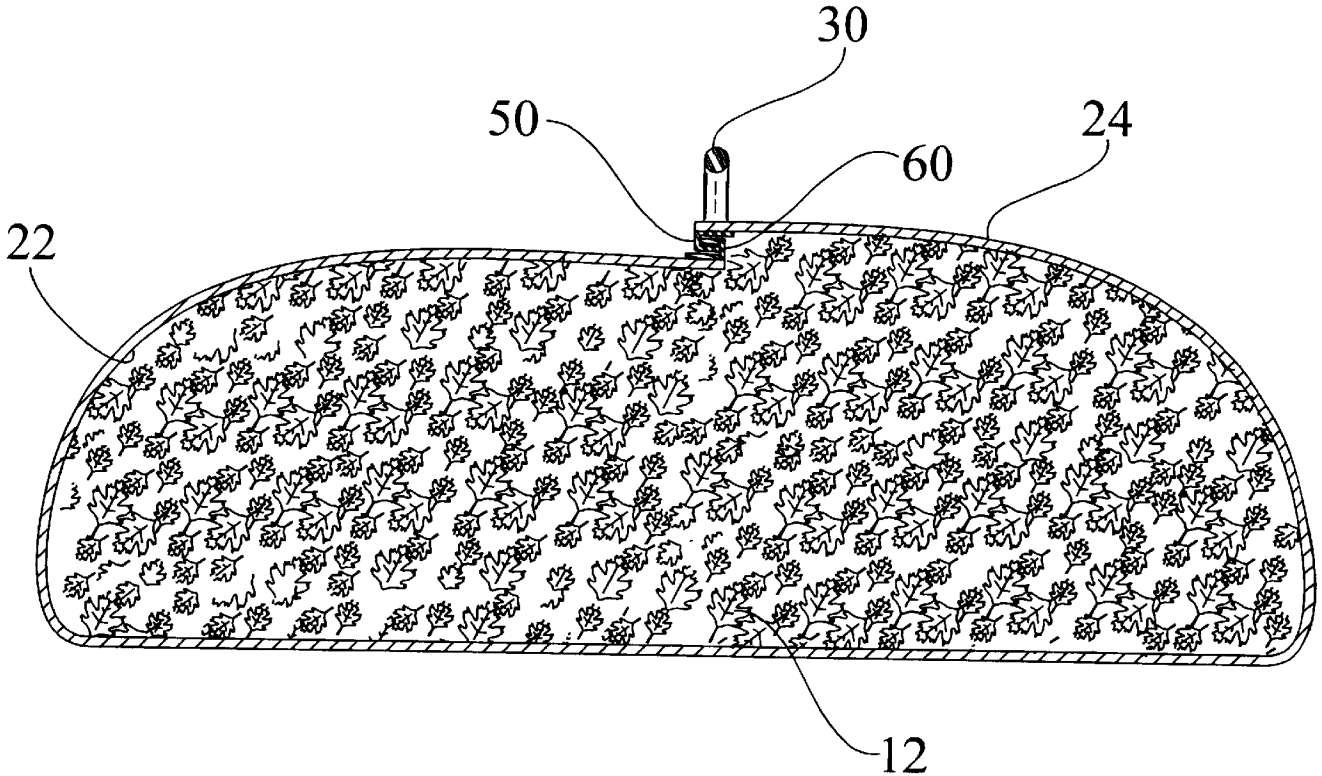
FIG. 7 is a side cutaway view taken along line 7—7 of FIG. 5.

As shown in FIGS. 2, 6 and 7 of the drawings, the sheet member 20 is comprised of a broad flat structure. The sheet member 20 has an inner surface 22 and an outer surface 24. The sheet member 20 may have various shapes and sizes depending upon the particular application and should not be limited by the drawings. However, it is desirable to have a generally square or rectangular structure with the end portions tapered as best illustrated in FIG. 2 of the drawings. The sheet member 20 is comprised of a flexible material such as but not limited to plastic or paper.

Figure 3:
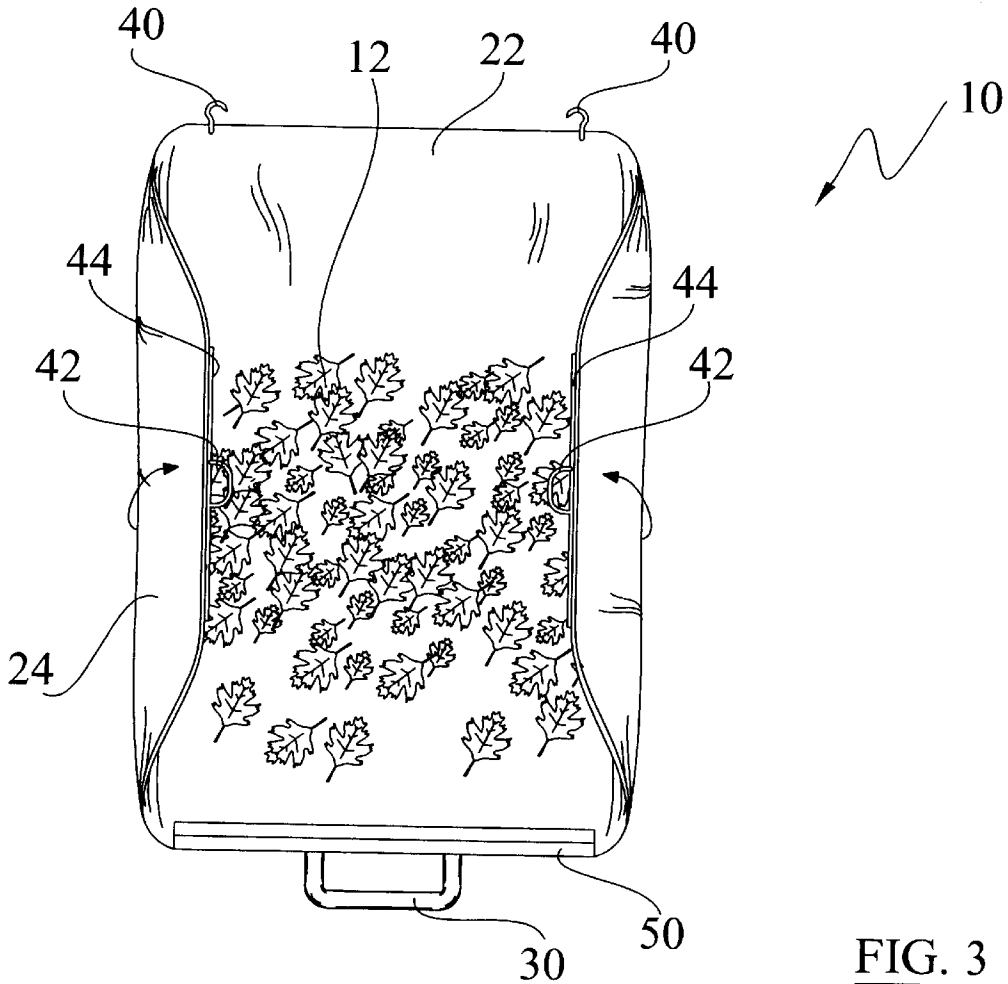
FIG. 3 is a top view of the present invention with the side portions elevated.

As best shown in FIGS. 2 and 3 of the drawings, at least one loop 42 is attached to each of the opposing sides of the sheet member 20. The loops 42 may be comprised of various looped structures.

The loops 42 are preferably reinforced within the sides of the sheet member 20 with brace members 44 as further shown in FIG. 2 of the drawings. The brace members 44 are preferably comprised of a rigid material extending a distance along the opposing sides of the sheet member 20 for providing reinforcement to the loops 42 to prevent tearing of the sheet material during usage thereof. The loops 42 are preferably centered along the sides of the sheet member 20 as shown in FIG. 2, however the loops 42 may be positioned along various other locations of the sheet member 20.

A first connector 50 is attached to a first end of the inner surface 22 of the sheet member 20 as shown in FIG. 2 of the drawings. The first connector 50 is comprised of an elongate structure that extends along the first end of the sheet member 20. The first connector 50 may be comprised of a various connecting and mating structures. FIG. 7 illustrates the first connector 50 having a U-shaped or cuffed cross section for mating with a corresponding structure in a sealed manner. The first connector 50 preferably extends along a significant portion of the first end for assisting in sealing of the present invention when in the closed position.

Figure 4:
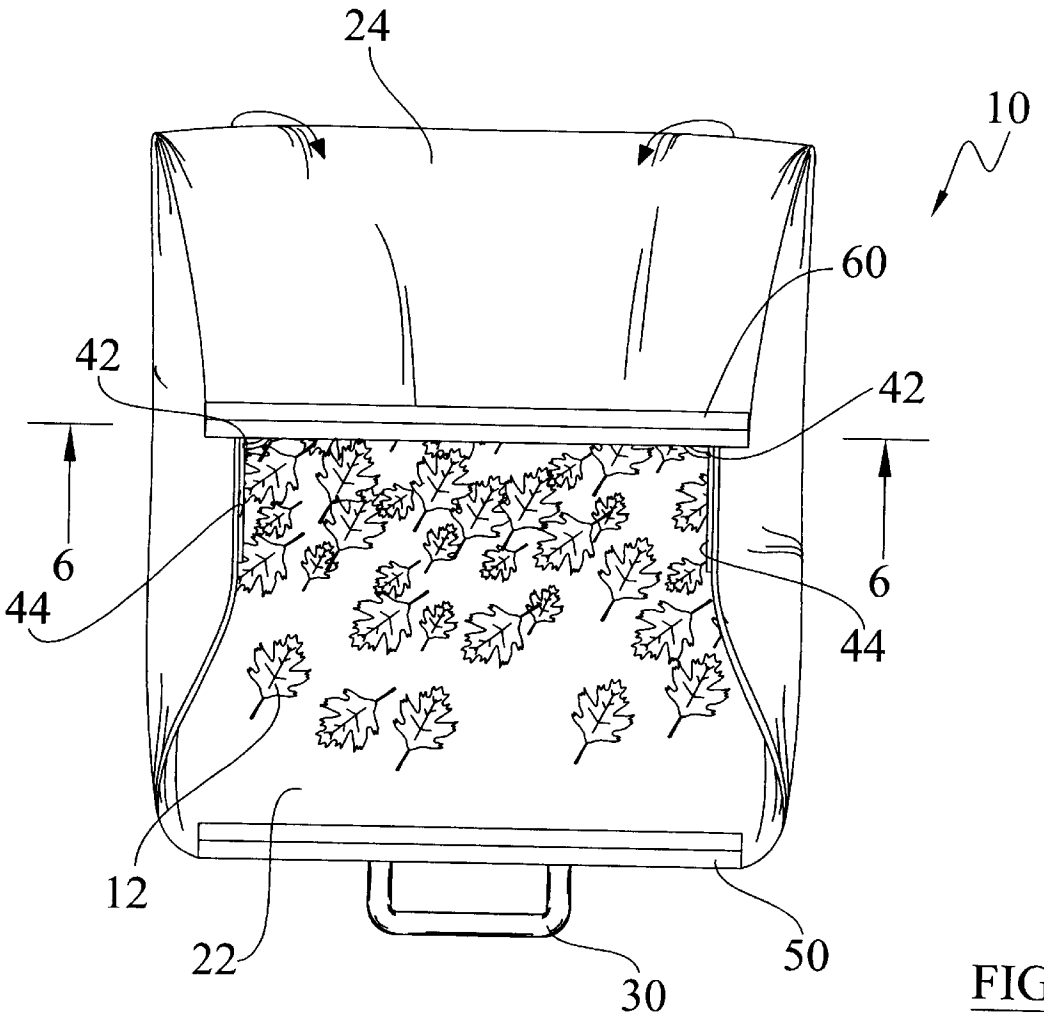
FIG. 4 is a top view of the present invention with an end portion elevated.
Figure 5:
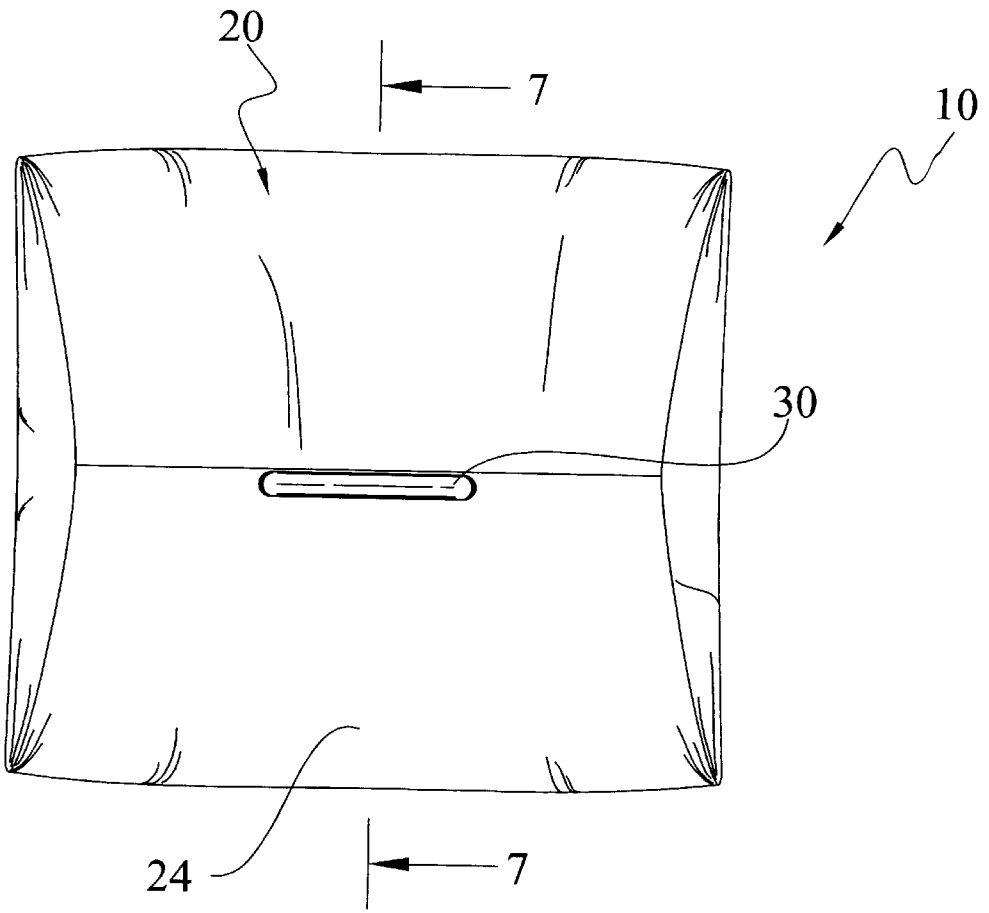
FIG. 5 is a top view of the present invention with the opposing end portions connected to one another.

A handle member 30 is preferably attached to the first connector 50 as shown in FIGS. 2 through 5 of the drawings. The handle member 30 allows for grasping and transporting of the invention when filled with leaves 12 and debris as shown in FIGS. 1 and 5 of the drawings. The handle member 30 is preferably comprised of a U-shaped structure, however various other structures may be utilized to construct the handle member 30.

A second connector 60 is attached to a second end of the outer surface 24 the sheet member 20 as shown in FIG. 4 of the drawings. The second connector 60 is comprised of an elongate structure that extends along the second end of the sheet member 20. The second connector 60 may be comprised of a various connecting and mating structures. FIG. 7 illustrates the second connector 60 having a U-shaped or cuffed cross section for mating with the first connector 50 in a sealed manner. The second connector 60 preferably extends along a significant portion of the second end for assisting in sealing of the present invention when in the closed position.

As shown in FIGS. 2 and 3 of the drawings, a plurality of hooks 40 are attached to an inner surface 22 of the second end of the sheet member 20. The hooks 40 are preferably connected to the second connector 60 for reducing tearing of the sheet member 20. The hooks 40 selectively engage a corresponding loop 42 when in the closed position as best illustrated in FIG. 6 of the drawings.

In use, the present invention may come in a plurality of stacked sheet members 20. The user may choose to position a single or a plurality of sheet members 20 upon the ground surface as desired. Once the sheet member 20 is positioned upon the ground surface in the location to be cleaned, the user then rakes the leaves 12 and debris directly upon the inner surface 22 of the sheet member 20 as shown in FIG. 2 of the drawings. After a desired volume of debris and leaves 12 has been collected, the user then elevates one or both sides of the sheet member 20 containing the loops 42 as shown in FIG. 3 of the drawings. The user then elevates the second end of the sheet member 20 and engages the hooks 40 within the respective loops 42 as shown in FIGS. 4 and 7 of the drawings. The user then elevates the first end of the sheet member 20 and engages the first connector 50 with the second connector 60 thereby forming a sealed and enclosed disposal bag with the leaves 12 and debris within as shown in FIGS. 1, 5, 6 and 7 of the drawings. The user then grasps the handle member 30 and transports the disposal bag system 10 to a desired location for disposal of the entire disposal bag system 10 or for emptying the contents within the disposal bag system 10 for allowing reuse of the disposal bag system. Since the disposal bag system 10 has a relatively flat upper and lower surface in the closed position, the user is able to stack a plurality of the disposal bag systems 10 when filled with leaves 12 and debris.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposal device, comprising:

a sheet member having an inner surface and an outer surface;

a first connector attached to a first end of said sheet member and a second connector attached to a second end of said sheet member, wherein said first connector and said second connector are selectively connectable to one another;

a first individual loop attached to a first side of said sheet member and a second individual loop attached to a second side of said sheet member; and a first hook attached to said second end of said sheet member and a second hook attached to said second end of said sheet member, wherein said hooks are formed for selectively engaging said loops.

2. The disposal device of claim 1, including a handle member attached to said first connector.

3. The disposal device of claim 1, wherein said first connector and said second connector each have a U-shaped cross section for interconnecting together in a relatively sealed manner.

4. The disposal device of claim 1, wherein said hooks are attached to said second connector.

5. The disposal device of claim 1, wherein said first connector and said second connector extending along a significant portion of their respective ends.

6. The disposal device of claim 1, wherein said sheet member has a generally rectangular shape.

7. The disposal device of claim 6, wherein said sheet member has a first end portion and a second end portion that are tapered.

8. The disposal device of claim 1, wherein said sheet member is comprised of a flexible material.

9. The disposal device of claim 8, wherein said sheet member is comprised of plastic or paper.

10. The disposal device of claim 1, wherein said first connector is attached to an inner surface of said sheet member and wherein said second connector is attached to an outer surface of said sheet member.

11. A disposal device, comprising:

a sheet member having an inner surface and an outer surface;

a first connector attached to a first end of said sheet member and a second connector attached to a second end of said sheet member, wherein said first connector and said second connector are selectively connectable to one another;

a first brace member attached to a first side of said sheet member and a second brace member attached to a second side of said sheet member;

a first loop attached to said first brace member and a second loop attached to said second brace member; and a first hook attached to said second end of said sheet member and a second hook attached to said second end of said sheet member, wherein said hooks are formed for selectively engaging said loops.

12. The disposal device of claim 11, including a handle member attached to said first connector.

13. The disposal device of claim 11, wherein said first connector and said second connector each have a U-shaped cross section for interconnecting together in a relatively sealed manner.

14. The disposal device of claim 11, wherein said hooks are attached to said second connector.

15. The disposal device of claim 11, wherein said first connector and said second connector extending along a significant portion of their respective ends.

16. The disposal device of claim 11, wherein said sheet member has a generally rectangular shape.

17. The disposal device of claim 16, wherein said sheet member has a first end portion and a second end portion that are tapered.

18. The disposal device of claim 11, wherein said sheet member is comprised of a flexible material.

19. The disposal device of claim 11, wherein said first connector is attached to an inner surface of said sheet member and wherein said second connector is attached to an outer surface of said sheet member.

20. A method of operating a disposal device, said disposal device comprising a sheet member having an inner surface and an outer surface, a first connector attached to a first end of said sheet member and a second connector attached to a second end of said sheet member, wherein said first connector and said second connector are selectively connectable to one another, a first loop attached to a first side of said sheet member and a second loop attached to a second side of said sheet member, and a first hook attached to said second end of said sheet member and a second hook attached to said second end of said sheet member, wherein said hooks are formed for selectively engaging said loops, said method comprising:

positioning said sheet member upon a surface with said inner surface facing upwardly;

manipulating debris upon said inner surface of said sheet member;

elevating said first side and said second side of said sheet member;

elevating said second end of said sheet member;

connecting said first hook to said first loop and said second hook to said second loop;

elevating said first end of said sheet member; and connecting said first connector to said second connector forming a substantially closed structure containing said debris.

* * * * *